US007231165B2

(12) United States Patent
Teshigawara

(10) Patent No.: US 7,231,165 B2
(45) Date of Patent: Jun. 12, 2007

(54) IMAGE FORMING APPARATUS

(75) Inventor: Toru Teshigawara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 75 days.

(21) Appl. No.: 10/940,712

(22) Filed: Sep. 15, 2004

(65) Prior Publication Data

US 2005/0163529 A1 Jul. 28, 2005

(30) Foreign Application Priority Data

Jan. 23, 2004 (JP) ..... P2004-015604

(51) Int. Cl.
*G03G 15/00* (2006.01)

(52) U.S. Cl. ..... 399/107; 399/302

(58) Field of Classification Search ..... 399/107, 399/302, 364, 393

See application file for complete search history.

(56) References Cited

U.S. PATENT DOCUMENTS 4,394,084 A * 7/1983 Kuehnle ..... 399/107
5,724,642 A * 3/1998 Cala ..... 399/364
6,647,229 B2 * 11/2003 Haraguchi et al. ..... 399/149
2002/0141784 A1 * 10/2002 Kusayanagi et al. ..... 399/179
2003/0095818 A1 * 5/2003 Nakayama ..... 399/328
2005/0036023 A1 * 2/2005 Costanza et al. ..... 347/104

FOREIGN PATENT DOCUMENTS

JP 2002-91105 3/2002

* cited by examiner

*Primary Examiner*—David M. Gray
*Assistant Examiner*—Erika J. Villaluna
(74) *Attorney, Agent, or Firm*—Morgan, Lewis & Bockius LLP

(57) ABSTRACT

An image forming apparatus includes: a recording medium supplying device that supplies a recording medium; an image carrier arranged beneath the recording medium supplying device in a gravitation direction; a carrying passage that transports the recording medium supplied from the recording medium supplying device, and arranged between the recording medium supplying device and the image carrier and having a horizontal carrying portion which extends approximately in a horizontal direction and serves to carry the recording medium; and a transferring unit that transfers, at the horizontal carrying portion of the carrying passage, a toner carried by the image carrier onto a lower surface in the gravitation direction of the recording medium supplied from the recording medium supplying device.

34 Claims, 5 Drawing Sheets

IMAGE FORMING APPARATUS

BACKGROUND OF THE INVENTION

1. Field of the Invention

This invention relates to an image forming apparatus such as a printer, a copying machine, and facsimile.

2. Description of the Related Art

An image forming apparatus is previously known in which a recording medium supplying device for supplying a recording medium to a recording portion for recording an image is arranged above the recording portion, and an operator can supply the recording medium to the recording medium supplying device from above the image forming apparatus (see JP-A-2002-091105).

SUMMARY OF THE INVENTION

However, such a conventional image forming apparatus has a problem that since the image is copied or duplicated on the recording medium beneath a photosensitive body in the recording portion, the carrying passage along which the recording medium is carried becomes long and hence the time required for the recording medium with the image recorded thereon to be outputted (shortest printing time) is also long.

In view of the above, the present invention intends to provide an image forming apparatus capable of supplying a recording medium from above an image carrier and of shortening the time required for the recording medium with the image recorded thereon to be outputted.

According to one aspect of the invention, there is provided an image forming apparatus includes: a recording medium supplying device that supplies a recording medium; an image carrier arranged beneath the recording medium supplying device in a gravitation direction; a carrying passage that transports the recording medium supplied from the recording medium supplying device, and arranged between the recording medium supplying device and the image carrier and having a horizontal carrying portion which extends approximately in a horizontal direction and serves to carry the recording medium; and a transferring unit that transfers, at the horizontal carrying portion of the carrying passage, a toner carried by the image carrier onto a lower surface in the gravitation direction of the recording medium supplied from the recording medium supplying device.

BRIEF DESCRIPTION OF THE DRAWINGS

The above objects and advantages of the present invention will become more apparent by describing in detail of a preferred embodiment thereof with reference to the accompanying drawings, wherein.

DETAILED DESCRIPTION OF THE PREFERRED EMBODIMENT

Figure 1:
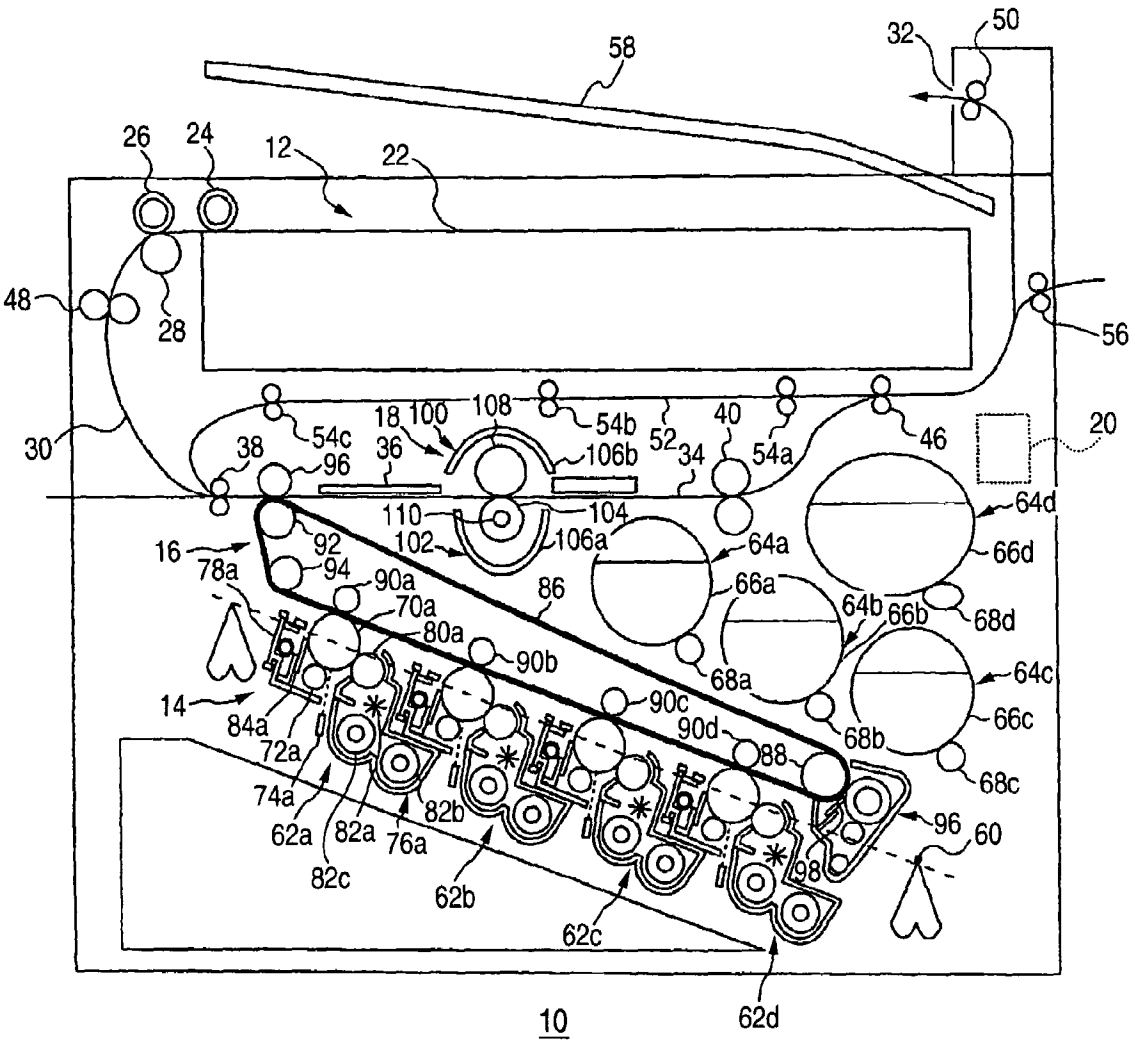
FIG. 1 is a front view of an image forming apparatus according to an embodiment of the invention.

Referring to the drawings, an explanation will be given of an embodiment of the invention.

FIG. 1 shows the schematic of an image forming apparatus 10 according to an embodiment of this invention. The image forming apparatus 10 includes a recording medium supplying device 12, a recording portion 14, an intermediate transferring device 16, a fixing device 18 and a control portion 20.

The recording medium supplying device 12 is arranged at the upper portion of the image forming device 10 and has a recording medium accommodating portion 22 in which recording media are accommodated. The recording medium accommodating portion 22 is provided with a pick-up roller 24 arranged at the upper part on the left side thereof. In front of the pick-up roller 24, a feed roller 26 and a retard roller 28 opposite thereto are arranged.

A carrying passage 30 is a recording medium passage extending from the feed roller 26 to a discharging port 32. The carrying passage 30 has a horizontal carrying portion 34 which extends nearly horizontally between the recording medium supplying device 12 and the intermediate transferring device 16 and has an entire length of e.g. 800 mm or less. At the nearly central position of the horizontal carrying portion 34, the fixing device 18 is arranged. On the upstream side of the fixing device 18, a secondary duplicating roller 96 and a secondary back-up roller 92 which will be described later are arranged. Between these secondary duplicating roller 96 and secondary duplicating 92, and the fixing device 18, a carrying device 36 is arranged for transporting the recording medium while being supported from above through e.g., sucking. Namely, the carrying device 36 partially constitutes the horizontal carrying portion 34. The distance over which the recording medium is carried by the carrying device 36 is set at e.g. 10 cm. On the upstream side of the secondary duplicating roller 96 and secondary duplicating back-up roller 92, a resist roller 38 is arranged. The resist roller 38 serves to temporarily stop the recording medium and carries the recording medium to the downstream side at a timing taken under the control by the control portion 20.

On the downstream side of the fixing device 18, a carrying roller 40 is arranged. On the downstream side of the carrying roller 40, an inverting roller 46 is arranged. The inverting roller 46 is adapted to make both normal and reverse rotations under control by the control portion 20. Between the feed roller 26 and retard roller 28, and the resist roller 38, a carrying roller 48 is arranged. In the vicinity of the discharging port 30, a discharging roller 50 is arranged.

An inverted carrying passage 52 is a recording medium passage from the inverting roller 46 to the resist roller 38 via carrying rollers 54*a* to 54*c*, and has a portion in nearly parallel to the horizontal carrying 34 between the recording medium supplying device 12 and the fixing device 18.

The image forming apparatus 10 is adapted so that a recording medium can be supplied onto a tray pulled out from the left side. Between the inverting roller 46 and the discharging roller 50, a discharging roller 56 is provided for discharging the recording medium toward a post-processing device (not shown) which may be attached to the right side of the image forming apparatus 10.

Therefore, the recording medium (media) fed out from the recording medium accommodating 22 by the pick-up roller 24 is solved in cooperation between the feed roller 26 and the retard roller 28, and only the uppermost medium is guided onto the carrying passage 30. The recording medium guided is temporarily stopped by the resist roller 38. The recording medium passes through between the secondary duplicating roller 96 and the secondary duplicating back-up roller 92 at timings so that a toner image is duplicated on the recording medium. The recording medium with the toner image duplicated thereon is carried to the fixing device 18 by the carrying device 36 so that the toner image is fixed. The recording medium with the toner image fixed thereon is carried toward the discharging roller 50 by the normal rotation of the inverting roller 46. Finally, by the discharging roller 50, the recording medium is discharged from the discharging port 32 to a discharging portion 58 provided above the recording medium supplying device 12.

In the case of duplex printing, the recording medium with the toner image fixed thereon is guided to the inverting carrying passage 52 through inversion by the inverting roller 46 and returned to the resist roller 38 again. The recording medium returned to the resist roller 38 is temporarily stopped and duplicated with a coloring image at a timing. The toner image duplicated is fixed by the fixing device 18. The recording medium with the toner image fixed is carried toward the discharging roller 50 by the normal rotation of the inverting roller 46, and discharged to the discharging port 58 from discharging port 32 by the discharging roller 50.

Figure 3:
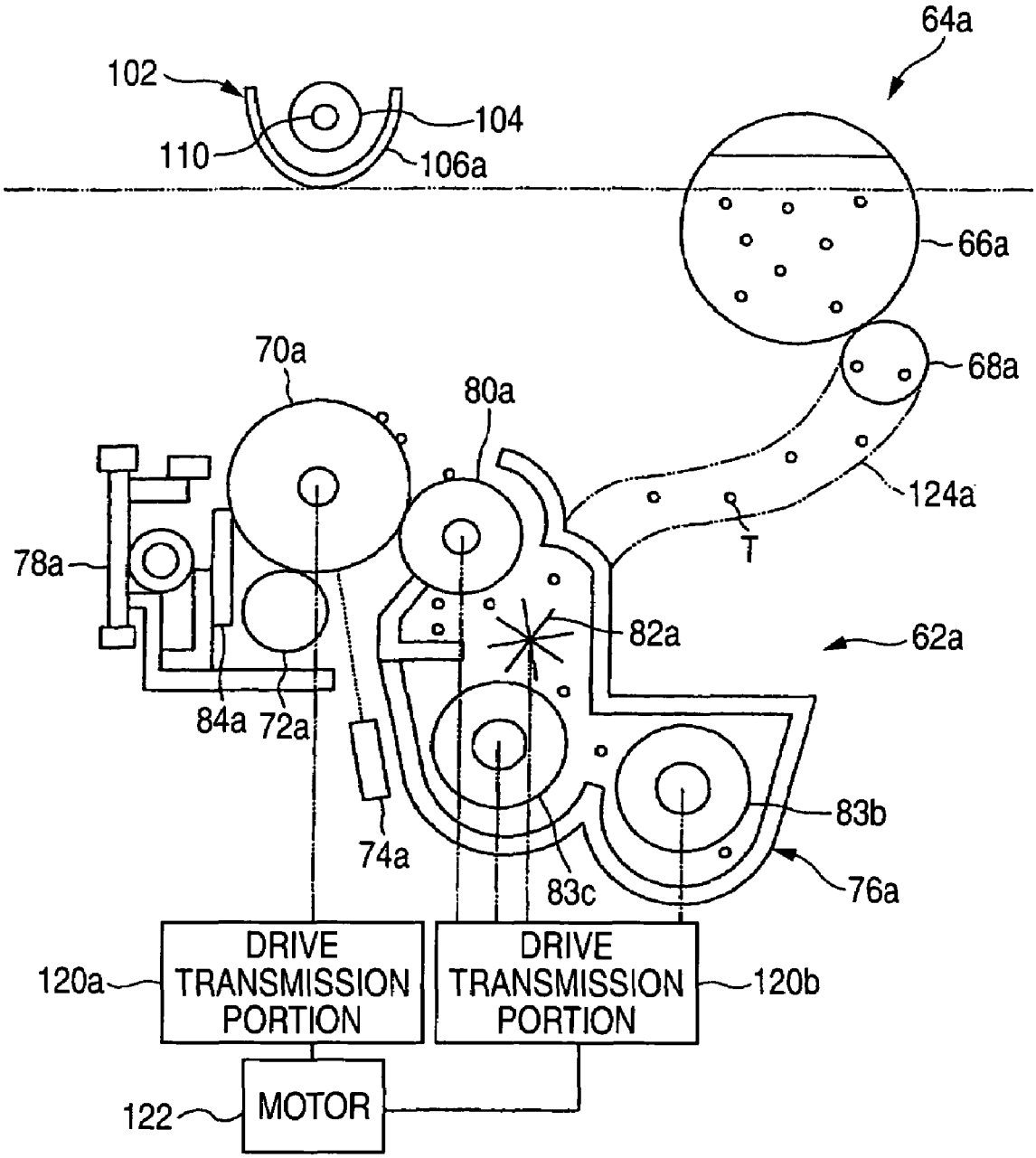
FIG. 3 is a schematic view of a main heat source for an image forming unit and toner box in the image forming apparatus according to the embodiment.

A recording portion 14 is arranged as a unit at the lower portion of the image forming apparatus 10. The recording portion 14 being integral to the intermediate transferring device 16 is rotatatively movable around a supporting shaft 60 at the lower position on the right side. The recording portion 14 has e.g. four image forming units 62*a* to 62*d* which are adapted to receive respective toners from toner boxes 64*a* to 64*d* arranged below the carrying passage 30. The toner boxes 64*a* to 64*d* have toner accommodating portions 66*a* to 66*d* for accommodating the toners of yellow, magenta, cyan and black and toner supplying ports 68*a* to 68*d*, respectively. The toners are supplied to the image forming units 62*a* to 62*d* from the toner supplying ports 68*a* to 68*d* through carrying pipes (FIG. 3). The toner boxes 64*a* to 64*c* for supplying the toners of yellow, magenta and cyan are arranged beneath the toner box 64*d* for supplying the toner of black. Further, the toner supplying ports 68*a* to 68*d* are arranged beneath the fixing device 18.

The image forming units 62*a*–62*d* include photosensitive bodies 70*a*–70*d*, chargers 72*a*–72*d*, optical writing devices 74*a*–74*d*, developers 76*a*–76*d* and cleaning devices 78*a*–78*d*, respectively. The chargers 72*a*–72*d* uniformly charge the photosensitive bodies 70*a*–70*d*, respectively. The optical writing devices 74*a*–74*d* are arranged beneath the image forming units 62*a*–62*d*. The optical writing devices 74*a*–74*d* generate scanning light beams toward the charged photosensitive bodies 70*a*–70*d*, respectively to form latent images on the photosensitive bodies 70*a*–70*d*. The chargers 76*a*–76*d* include developing rollers 80*a*–80*d*, first stirring/carrying members 81*a*–81*d*, second stirring/carrying members 82*a*–82*d* and third stirring/carrying members 83–83*d*. The chargers 76*a*–76*d* stir/carry the toners received from the toner boxes 64*a*–64*d* through the first stirring/carrying members 81*a*–81*d*, second stirring/carrying members 82*a*–82*d* and third stirring/carrying members 83*a*–83*d* to the developing rollers 80*a*–80*d*, thus developing the latent images created on the photosensitive bodies 70*a*–70*d* into visualized toner images, respectively using the developing rollers 80*a*–80*d*. The cleaning devices 78*a*–78*d* has blades 84*a*–84*d*. The cleaning devices 78*a*–78*d*, after the toner images have been transferred from the photosensitive bodies 70*a*–70*d* onto an intermediate transferring member 86 described later, scrape away the toners remaining on the photosensitive bodies 70*a*–70*d* and paper chips resulting from the recording medium by the blades 84*a*–84*d* and accommodate them in the cleaning devices 78*a*–78*d* themselves.

The intermediate transferring device 16 is arranged between the recording portion 14 and the fixing device 18. The intermediate transferring device 16 includes an intermediate transferring member 86, a driving roller 88, primary-duplicating rollers 90*a*–90*d*, a secondary-duplicating back-up roller 92 and a correcting roller 94. As described above, the intermediate transferring device is rotatively movable integrally to the recording portion 14 around the supporting shaft 60. The intermediate transferring member 86 is an intermediate duplicating belt which is supported by e.g. the driving roller 88, primary-duplicating rollers 90*a*–90*d*, second-duplicating back-up roller 92 and correcting roller 94. The toner images are transferred from the photosensitive bodies 70*a*–70*d* of the image forming units 62*a*–62*d* onto the intermediate transferring member 86. The driving roller 88 is driven by the driving device not shown, and rotates the intermediate transferring member 86 clockwise (clockwise in FIG. 1). The primary duplicating rollers 90*a*–90*d* are brought into pressure-contact with the photosensitive bodies 70*a*–70*d* of the image forming units 62*a*–62*d* through the intermediate transferring member 86 so that the toner images carried on the photo-sensitive bodies 70*a*–70*d* are primary-duplicated onto the intermediate transferring member 86. The secondary duplicating roller 96 is opposite to the secondary duplicating back-up roller 92 with respect to the carrying passage 30. Namely, the secondary duplicating position is located between the secondary duplicating roller 96 and the secondary duplicating back-up roller 92. The secondary duplicating roller 96, through the assistance of the secondary duplicating back-up roller 92, secondary-duplicates the toner images primary-duplicated on the intermediate transferring member 86 onto the recording medium at the secondary duplicating position. The correcting roller 94 serves to correct the meandering of the intermediate transferring member 86.

The intermediate transferring device 16 is arranged so that it extends from the secondary duplicating position downward on the right side, and the part (on the side opposite to the secondary transfer position) supported by the driving roller 88 of the intermediate transferring member 86 is the lowermost. The secondary transferring device 16 is so adapted that the upper face of the intermediate transferring member 86 rotates from the secondary duplicating position downward, e.g. inclined by 15° or more with respect to the horizontal carrying portion 34. On the side opposite to the secondary duplicating position of the intermediate transferring member 86, a cleaning device 96 is provided for cleaning the intermediate transferring member 86. The cleaning device 96 has a blade 98 which scrapes away the toners remaining on the intermediate transferring member 86 after the secondary duplicating has been completed and paper chips resulting from the recording medium. The blade 98 constitutes a part of the accommodating portion which accommodates the toners and paper chips scraped.

Figure 2:
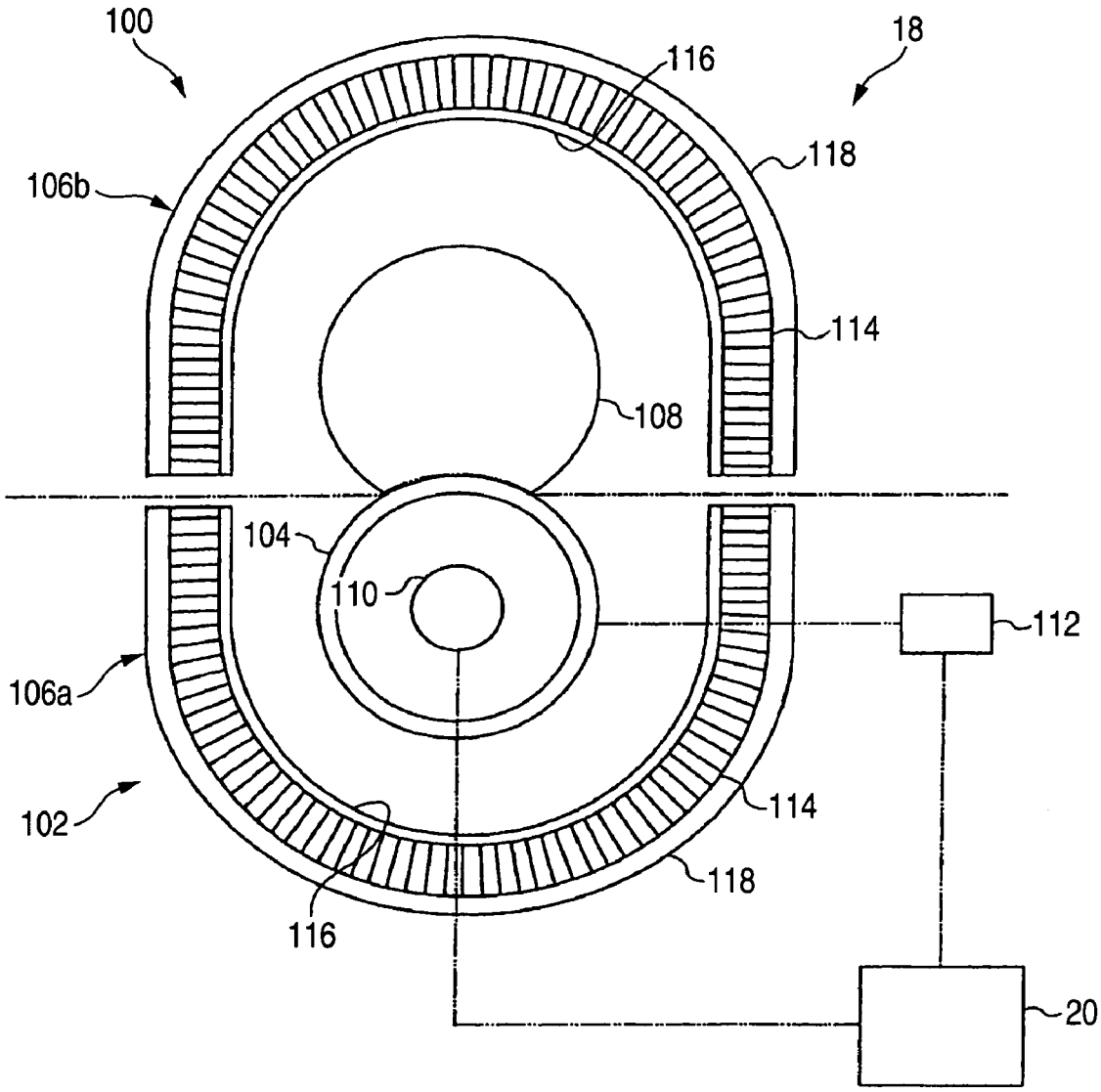
FIG. 2 is a sectional view showing a fixing device employed in the image forming apparatus according to the embodiment.

FIG. 2 shows the details of the fixing device 18.

The fixing device 18 includes an upper unit 100 and a lower unit 102, and is arranged between the recording medium supplying device 12 and the intermediate transferring device 16. Namely, the fixing device 18 is located in a nearly horizontal direction with respect to the secondary duplicating position, and at the nearly central position of the image forming apparatus 10. The lower unit 102 has a heating roller 104 and a heat insulating material 106*a*. The upper unit 100 has a pressurizing roller 108 and a heat insulating material 106*b*. The heating roller 104 has a heater arranged e.g. internally. The pressurizing roller 108 is arranged in a vertical direction above the heating roller 104. The heating roller 104 and pressurizing roller 108 are covered with the heat insulating materials 106*a* and 106*b* in the vertical direction, respectively so as to be apart therefrom by a distance of such in a range from 3 mm to 20 mm. Namely, the fixing device 18 is so adapted that the recording medium passes nearly horizontally between the heat insulating members 106*a* and 106*b* and a nipping portion formed by the heating roller 104 and pressurizing roller 108.

Incidentally, the fixing device 18 is so adapted that the surface temperature of the heating roller 104 is detected by a temperature sensor 112 such as a thermo-couple and a control portion 20 intermittently applies a voltage to the heater on the basis of the temperature detected by the temperature sensor 112 so that the temperature of the heating roller 104 is kept at a predetermined temperature.

Further, the heating roller 104 and heat-insulating material 106*a* may be separated from the pressurizing roller 108 and heat-insulating material 106*b*, and may be made rotatively movable integrally to the recording portion 14 and intermediate transferring device 16 around the supporting shaft 60.

The heat-insulating materials 106*a*, 106*b* each has a vacuum heat-insulating material 114 with a thermal conductivity of 0.03 W/mK or less and thickness of 3 mm or more. The heat-insulating material 106*a*, 106*b* is provided with a reflecting layer 116 with reflectivity of e.g. 60% or more on the inner wall and a cover 118 of e.g. plastic on the outer wall. The reflecting layer 116 is made of e.g. alumite, or metal of mirror-finished aluminum, stainless, iron plate, etc. The reflecting layer 116, where it is made of alumite, may be plated with nickel, chrome, palladium, tin, gold or silver to provide emissivity of 0.5 or less.

In this way, the fixing device 18, in which the pressurizing roller 108 is arranged in the nearly vertical direction above the heating roller 104 and the heating roller 104 and pressurizing roller 108 are covered with the heat-insulating materials 106*a*, 106*b* in the vertical direction, can effectively employ the heat generated by the heater 110, thereby restraining the heat from being externally discharged therefrom.

Further, the heating roller 104 may be an IH type (Induction Heating Fuser). The heating roller 104 constructed in the IH type can effectively use heat because it is not energized during its non-employment and can improve the heat-insulation in an axial direction because it does not employ the heater. Thus, even where the fixing device 18 is arranged at the nearly central position of the image forming apparatus 10, the effect of heat given to the other components such as the intermediate transferring member 86 arranged around the fixing device 18 can be reduced.

An explanation will be given of the heat source for the image forming units 62*a*–62*d* and toner boxes 64*a*–64*d*.

The image forming units 62*a*–62*d* are constructed in the same manner except that the colors of the images formed are different from one another. Therefore, only the image forming unit 62*a* will be explained below.

In FIG. 3, the main heat sources for the image forming unit 62*a* and toner box 64*a* are illustrated. The fixing device 18 having the heater 110 is one of the heat sources for the image forming unit 62*a* and the toner box 64*a*. The heat generated by the heater 110 makes higher the temperature above the heater 110 than below the heater 110. The heater 110 is covered with the heat-insulating material 106*a* on the lower side. The toner supplying port 68*a* of the image forming unit 62*a* is located below the fixing device 18 so that it is made difficult to suffer from the effect of heat by the heater 110.

The photosensitive body 70*a* is driven by a motor 122 through a drive transmission portion 120*a* such as a gear. The developing roller 80*a* of the developer 76*a*, first stirring/carrying member 81*a*, second stirring/carrying member 82*a* and third stirring/carrying member 83*a* are driven by the motor 122 through a drive transmission portion 120*b* such as a gear. The photosensitive body 70*a* is adapted to provide an axial torque of 0.4 Nm or less by decreasing the surface friction coefficient and giving the transmission efficiency of 60% or more of the drive transmission portion 120*a*. The developing roller 80*a* of the developer 76*a* first stirring/carrying member 81*a*, second stirring/carrying member 82*a* and third stirring/carrying member 83*a* are adapted to provide the total axial torque of 0.3 Nm or less by giving the transmission efficiency of 70% of the drive transmission portion 120*a*.

On the other hand, the toner box 64*a* arranged above the intermediate transferring device 16 supplies a toner T to the developer 76*a* arranged beneath the intermediate duplicating 16. Specifically, the toner box 64*a* supplies the toner T from the toner supplying port 68*a* through a carrying pipe 124*a* by the use of gravitation. The toner T supplied by the toner box 64*a* contains at least binding resin for improving the integrity and has a volume average grain diameter of 3.0 to 7.5 mm. The binding resin is crystalline resin with a main constituent having a melting point of 50° C. to 120° C.

Thus, the heat generated by the heater 110 can prevent the toner T from stopping at the toner supplying port 68*a*. The entire toner box 64*a* may be arranged beneath the fixing device 18.

In this way, by reducing the heat generated for the image forming units 62*a* to 62*d* and toner boxes 64*a* to 64*d* and causing the toner to be fixed on the recording medium by less quantity of heat, even where the fixing device 18 is arranged at the nearly central position of the image forming apparatus 10, the effect of heat given to the other components such as the intermediate transferring member 86 arranged around the fixing device 18 can be reduced.

An explanation will be given of the operation of the image forming apparatus 10.

When an image forming signal is issued from the control portion 20, the photosensitive bodies 70*a*–70*d* are charged equally by the chargers 72*a*–72*d*. Toward the photosensitive bodies 70*a*–70*d* charged, on the basis of the image forming signal, light beams are emitted from the optical writing devices 74*a*–74*d*. The light beams emitted from the optical writing devices 74*a*–74*d* exposes the surface of the photosensitive bodies 70*a*–70*d* to light to form latent images. The latent images of the photosensitive bodies 70*a*–70*d* formed by the optical writing devices 74*a* to 74*d* are developed into the toner images of yellow, magenta, cyan and black and superposedly primary-duplicated on the intermediate transferring member 86. In this primary duplication, the waste toners remaining in the photosensitive bodies 70*a*–70*d* are scraped by the cleaning devices 78*a*–78*d* and recovered.

On the other hand, the recording medium accommodated in the recording medium accommodating portion 22 on the basis of a recording medium supplying signal is fed out by the feed roller 26, solved by the retard roller 28, and guided to the carrying passage 30. The recording medium is temporarily stopped by the resist roller 38, and guided in between the secondary duplicating roller 96 and the secondary duplicating back-up roller 92 at a timing. When the recording medium is guided in between the secondary duplicating roller 96 and the secondary duplicating back-up roller 92, the toner image primary-duplicated on the intermediate transferring member 86 is secondary-duplicated on the recording medium by the secondary duplicating roller 96 and secondary back-up roller 92. After the secondary duplication, the waste toner remaining on the intermediate transferring member 86 is scraped by the intermediate duplicating cleaner 82 and recovered.

The recording medium with the toner image duplicated is guided to the fixing device 18. By the fixing device 18, the toner image is fixed on the recording medium through thermal pressure by the heating roller 104 and pressurizing roller 108. The recording medium with the toner image fixed thereon is guided to the inverting roller 46. The recording medium guided to the inverting roller 46 is carried toward the discharging roller 50 by the normal rotation of the inverting roller 46. Finally, by the discharging roller 50, the recording medium is discharged from the discharging port 32 to the discharging portion 58 provided above the recording medium supplying device 12. In the case of the duplex printing, the recording medium with the toner image fixed thereon is guided to the inversion carrying passage 52 through inversion by the inverting roller 46 and returned to the resist roller 38 again. The recording medium returned to the resist roller 38 is duplicated with the coloring image at a timing. The toner image duplicated is fixed by the fixing device 18. The recording medium with the toner image fixed thereon is carried toward the discharging roller 50 by the normal rotation of the inverting roller 46, and discharged to the discharging port 58 from discharging port 32 by the discharging roller 50.

An explanation will be given of modifications of the image forming apparatus 10.

FIGS. 4A–4D are views illustrating modifications of the image forming apparatus 10. FIGS. 4A–4D are front views illustrating the first to fourth modifications, respectively.

Figure 4A:
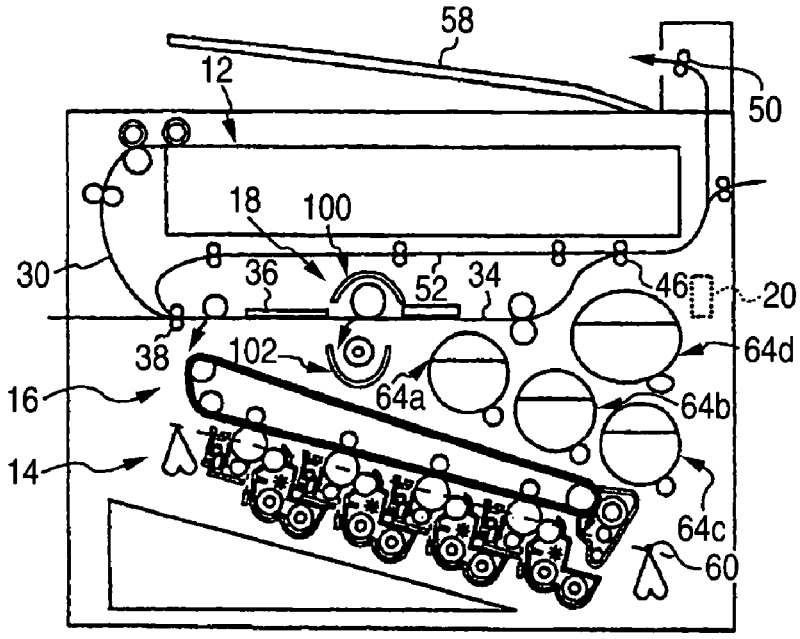
FIGS. 4A–4D are views showing modifications of the image forming device according to the embodiment, and showing front views of each of the modifications, respectively.

As shown in FIG. 4A, in the first modification of the image forming apparatus 10, the recording portion 14 and intermediate transferring device 16 are united, and this unit is made rotatively movable around the supporting shaft 60. The lower unit 102 of the fixing device 18 is equally made rotatable around the supporting shaft 60. The recording portion 14, intermediate transferring device 16 and lower unit 102 may be made rotatively moved together within a predetermined range. The united recording portion 14 and intermediate transferring device 16 and the lower unit 102 may be made rotatable individually within their predetermined ranges, respectively. For example, after the recording portion 14 and intermediate transferring device 16 and the lower unit 102 have been rotatively moved downward together within the predetermined range, the united recording portion 14 and intermediate transferring device 16, and the lower unit 102 may be made rotatatively movable individually within their predetermined ranges, respectively.

Figure 4B:
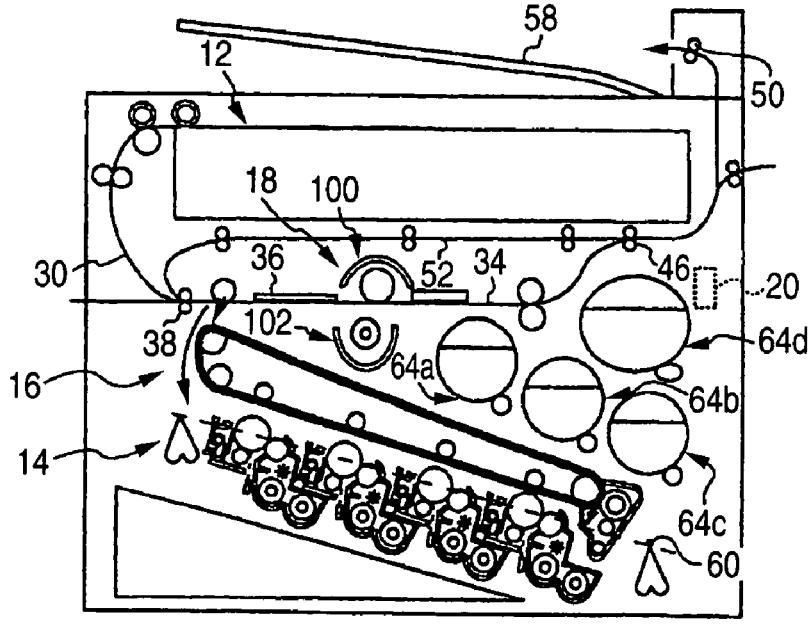

As shown in FIG. 4B, in the second modification of the image forming apparatus 10, the recording portion 14 and intermediate transferring device 16 are rotatively moved individually around the supporting shaft 60, respectively. The recording portion 14 and the intermediate transferring device 16 may be made rotatively moved together within a predetermined range. The united recording portion 14 and the intermediate transferring device 16 may be made rotatively movable individually within their predetermined ranges, respectively. For example, after the recording portion 14 and the intermediate transferring device 16 have been rotatively moved downward together within the predetermined range, the recording portion 14 and the intermediate transferring device 16 may be made rotatatively movable individually within their predetermined ranges, respectively.

Figure 4C:
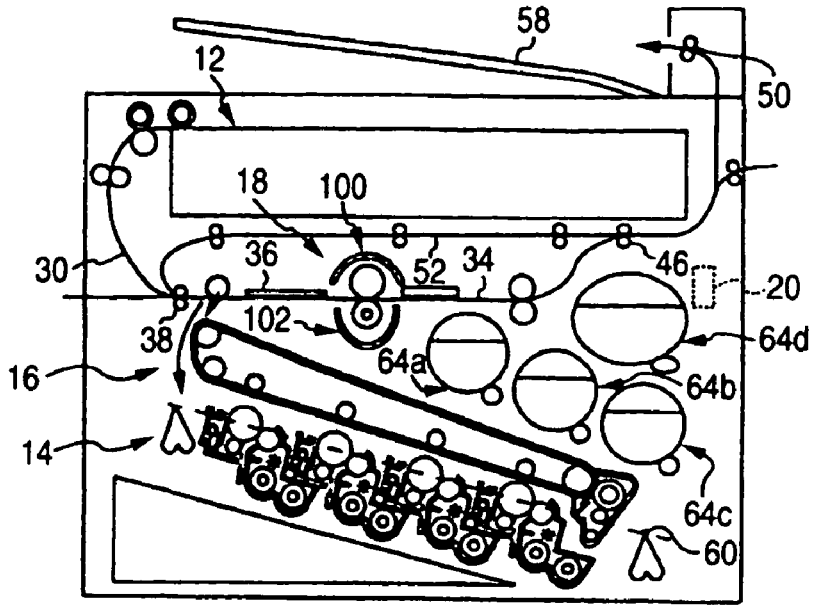

As shown in FIG. 4C, in the third modification of the image forming apparatus 10, the intermediate transferring device 16 and lower unit 102 are united, and this unit and the recording portion 14 are made rotatively movable around the shaft 60. Further, the united intermediate transferring device 16 and lower unit 102 and the recording portion 14 may be made rotatively moved together within a predetermined range, or otherwise may be made rotatable individually within their predetermined ranges, respectively. For example, after the united intermediate transferring device 16 and lower unit 102 and the recording portion 14 have been rotatively moved downward together within the predetermined range, the united intermediate transferring device 16 and lower unit 102, and the recording portion 14 may be made rotatatively movable individually within their predetermined ranges, respectively.

Figure 4D:
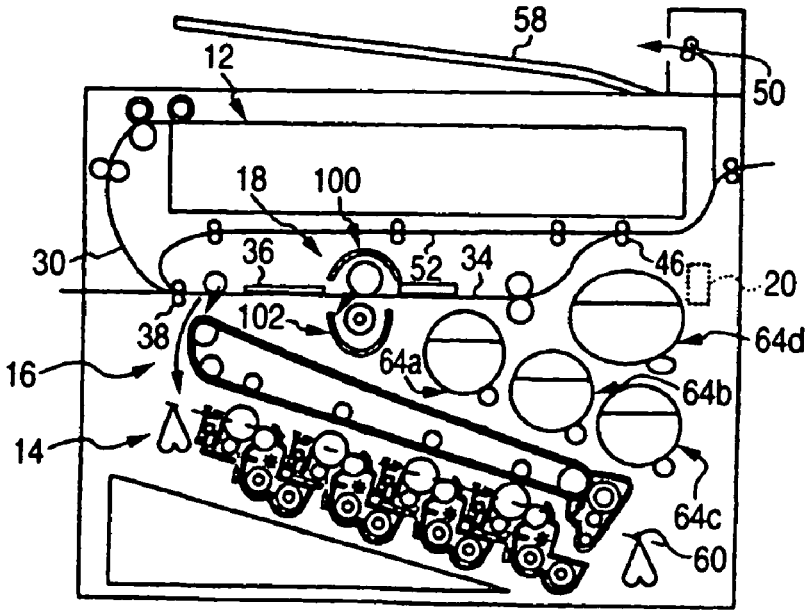

As shown in FIG. 4D, in the fourth modification of the image forming apparatus 10, the recording portion 14, intermediate transferring device 16 and lower unit 102 are made rotatively movable around the supporting shaft 60. The recording portion 14, intermediate transferring device 16 and lower unit 102 may be made rotatively moved together within a predetermined range. The recording portion 14 and intermediate transferring device 16 and lower unit 102 may be made rotatable individually within their predetermined ranges, respectively. Otherwise, the recording medium and intermediate transferring device 16, or the intermediate transferring device 16 and lower unit 102 may be made rotatively movable together within their predetermined ranges, respectively. For example, after the recording portion 14, intermediate transferring device 16 and lower unit 102 have been rotatively moved downward together within a predetermined range, the recording portion 14 and intermediate transferring device 16 are rotatively moved downward together within the predetermined range, and thereafter the recording portion 14 and intermediate transferring device 16 are rotatively moved downward individually within the predetermined ranges, respectively.

According to one aspect of the present invention, there is provided an image forming apparatus including: a recording medium supplying device for supplying a recording medium; an image carrier arranged beneath the recording medium supplying device in a gravitation direction; a carrying passage, arranged between the recording medium supplying device and the image carrier and having a horizontal carrying portion which extends nearly horizontally and serves to carry the recording medium, for transporting the recording medium supplied from the recording medium supplying device; and a transferring unit for duplicating, at the horizontal carrying portion of the carrying passage, a toner carried by the image carrier onto the lower surface in the gravitation direction of the recording medium supplied from the recording medium supplying device.

In accordance with the above configuration, the recording medium can be supplied to the recording medium supplying device above an image carrier and the carrying passage can be shortened so that the time required for the recording medium with the image recorded thereon to be outputted can be shortened.

Preferably, the image forming apparatus may further include a fixing unit for fixing the toner transferred by the transferring unit on the recording medium, and the fixing unit is arranged nearly horizontally with respect to a transfer position where the transferring unit transfers the toner onto the recording medium. In accordance with this configuration, the distance between the duplicating position and the fixing unit can be shortened and hence the carrying passage can be shortened so that the time required for the recording medium with the image recorded thereon to be outputted can be shortened.

Preferably, the fixing unit may include a fixing member for applying heat and pressure to the recording medium and to the toner transferred on the recording medium, and a reflecting layer arranged apart by 20 mm or less from the fixing member and having a metallic face with an emissivity of 0.5 or less. In accordance with this configuration, it is possible to restrain the heat applied from the fixing member from being discharged through the fixing unit and to effectively use the heat applied from the fixing member. Thus, the recording medium can be supplied to the recording medium supplying device above an image carrier and the carrying passage can be shortened.

Preferably, the image forming apparatus may further include a temperature detecting unit for detecting the temperature of the fixing unit, and the fixing member performs heating on the basis of at least the temperature detected by the temperature detecting unit. In accordance with this configuration, it is possible to prevent the fixing member from discharging unnecessary heat, and effectively use the heat generated by the fixing member.

Preferably, in the image forming apparatus, the fixing unit may configured to be of an IH type (induction heating fuser). Accordingly, while the fixing unit is not employed, the fixing unit is not energized. In addition, attachment/detachment or electric connection of a heater is not required. This improves the heat-insulation in an axial direction and permits the heat applied from the fixing member to be effectively used.

Preferably, in the image forming apparatus, the fixing unit may have an heat insulating layer having a thickness of 3 mm or more and thermal conductivity of 0.3 W/mK or less. In accordance with this configuration, it is possible to restrain the heat applied from the fixing member from being discharged through the fixing unit and to effectively use the heat applied from the fixing member. Thus, the recording medium can be supplied to the recording medium supplying device above an image carrier and the carrying passage can be shortened.

Preferably, the image forming apparatus may further include an inversion transporting unit for transporting the recording medium with the toner transferred thereon by the transferring unit, while being inverted, to a more upstream side of the carrying passage than the transferring unit, and the inversion transporting unit is arranged between the recording medium supplying unit and the image carrier. In accordance with this configuration, the recording medium can be supplied to the recording medium supplying device above the image carrier, and the time required for the recording medium with both-side printed images to be outputted can be shortened.

Preferably, in the image forming apparatus, the image carrier may include a photosensitive body. The image forming apparatus may further includes a plurality of photosensitive bodies carrying latent images, a plurality of chargers for charging these photosensitive bodies, exposing unit for exposing the plurality of photosensitive bodies, respectively, and a plurality of developing unit for developing the latent images carried on the plurality of photosensitive bodies through toners, and the image carrier is an intermediate transferring member on which the toner images developed by the plurality of developing unit are transferred from the plurality of photosensitive bodies. The color number of toners transferred on the recording medium may be single or plural.

Preferably, the image forming apparatus may further include a plurality of photosensitive body driving devices for driving the plurality of photosensitive bodies, respectively, the plurality of photosensitive body driving devices having a shaft torque of 0.4 Nm or less, respectively when the plurality of photosensitive bodies are driven and a driving force transmission efficiency of 60% or more. In accordance with this configuration, the heat generated as a loss from the photosensitive body driving devices can be reduced so that deterioration or inconvenience of the respective components constituting the image forming apparatus owing to heat can be restrained. This improves the integration degree of the respective components constituting the image forming apparatus.

Preferably, the image forming apparatus may further include a plurality of developing unit driving devices for driving the plurality of developing unit, respectively, the plurality of developing unit driving devices having a total shaft torque of 0.3 Nm or less, respectively and a driving force transmission efficiency of 70% or more. In accordance with this configuration, the heat generated as a loss from the photosensitive body driving devices can be reduced so that deterioration or inconvenience of the respective components constituting the image forming apparatus owing to heat can be restrained. This improves the integration degree of the respective components constituting the image forming apparatus.

Preferably, in the image forming apparatus, the intermediate transferring unit may have a gradually increasing distance apart from the horizontal carrying portion from a duplicating position where the transferring unit transfers the toner image onto the recording medium toward the direction of transporting the recording medium. This facilitates scraping of the recording medium with the toners transferred thereon from the intermediate transferring member.

The image forming apparatus may further include a plurality of toner supplying unit for supplying the toners to the plurality of developing unit, respectively. The fixing unit has a heat-generating unit arranged above the plurality of developing unit for heating the toners transferred on the recording medium, and the plurality of toner supplying unit are arranged between the plurality of developing unit supplied with the toners and the heat generating unit. In accordance with this configuration, it is possible to prevent the toners from being packed in the plurality of toner supplying unit owing to heat generated by the heat generating unit. Further, gravitation can be employed in order to supply the toners from the plurality of toner supplying unit to the plurality of developing unit so that the configuration of the plurality of toner supplying unit can be made simple.

The image forming apparatus may further include a plurality of toner supplying unit for supplying the toners to the plurality of developing unit, respectively. The fixing unit has a heat-generating unit arranged above the plurality of developing unit for heating the toners transferred on the recording medium, and the plurality of toner supplying unit which supply toners of at least yellow, magenta and cyan, respectively are arranged between the plurality of developing unit supplied with the toners of at least yellow, magenta and cyan and the heat generating unit, respectively. In accordance with this configuration, it is possible to reduced the effect of heat for the toners of at least yellow, magenta and cyan due to the heat-generating unit, and hence to prevent the toners of at least yellow, magenta and cyan from being packed in the plurality of toner supplying unit owing to heat generated by the heat generating unit.

Preferably, the image forming apparatus may further include a plurality of photosensitive body cleaning unit for cleaning the plurality of photosensitive bodies, and an intermediate transferring member cleaning unit for cleaning the intermediate transferring member. The plurality of photosensitive body cleaning unit are arranged beneath the intermediate member and are, at their upper parts, kept in sliding contact with the plurality of photosensitive bodies, respectively, and the intermediate transferring member cleaning unit is arranged beneath the intermediate member and is, at its upper part, kept in sliding contact with the intermediate transferring member.

In accordance with this configuration, the photosensitive cleaning unit and intermediate transferring member cleaning unit can clean the photosensitive bodies and intermediate transferring member using gravitation, thereby simplifying the configuration of the photosensitive body cleaning unit and the intermediate transferring member cleaning unit.

Preferably, in the image forming apparatus, at least the plurality of photosensitive bodies, the plurality of developing unit and the intermediate transferring member may be configured to integrally move in a direction leaving the transferring unit.

Preferably, in the image forming apparatus, at least the plurality of photosensitive bodies, the plurality of developing unit, the intermediate transferring member and the heat-generating unit may be configured to integrally move in a direction leaving the transferring unit.

Preferably, the image forming apparatus may further include a first unit including at least the plurality of photosensitive bodies and the plurality of developing unit and a second unit including at least the intermediate transferring member. The first unit and the second unit are rotatively moved in a direction leaving the transferring unit around a supporting shaft located at the position opposite to the transferring unit.

Preferably, the image forming apparatus may further include a first unit including at least the plurality of photosensitive bodies, the plurality of developing unit and the intermediate transferring member and a second unit including at least the heat-generating unit. The first unit and the second unit are rotatively moved in a direction leaving the transferring unit around a supporting shaft located at the position opposite to the transferring unit.

Preferably, the image forming apparatus may further include a first unit including at least the plurality of photosensitive bodies and the plurality of developing unit and a second unit including at least the intermediate transferring member and heat-generating unit. The first unit and the second unit are rotatively moved in a direction leaving the transferring unit around a supporting shaft located at the position opposite to the transferring unit.

Preferably, the image forming apparatus may further include a first unit including at least the plurality of photosensitive bodies and the plurality of developing unit, a second unit including at least the intermediate transferring member and a third unit including at least the heat-generating unit. The first unit, the second unit and the third unit are rotatively moved in a direction leaving the transferring unit around a supporting shaft located at the position opposite to the transferring unit.

Preferably, the first unit may configured to be rotatively moved together with the second unit within a predetermined range.

Preferably, at least one of the first unit and the second unit may be configured to be rotatively moved individually within a predetermined range.

Preferably, the first unit may configured to be rotatively moved together with the second unit and the third unit within a predetermined range.

Preferably, at least one of the first unit, the second unit and the third unit may be configured to be rotatively moved individually within a predetermined range. In accordance with these configurations, where maintenance such as removal of jamming of the recording medium and exchange of the components is performed, the number of operations can be reduced, and the maintenance can be performed unidirectionally.

Preferably, the toner carried on the image carrier may have a volume average grain diameter in a range of from 3.0 mm to 7.5 mm.

Preferably, the toner carried on the image carrier contains at least binding resin to improve integrity. Preferably, the binding resin may be crystalline resin with an main component having a melting point of 50° C.–120° C. Therefore, the fixing property of the toners onto the recording medium can be improved and flexibility can be given to the arrangement of the fixing unit. This shortens the carrying passage and shortens the time required for the recording medium with both-side printed images to be outputted.

As described above, according to the present invention, a recording medium can be supplied to an image forming device above an image carrier and the time required for the recording medium with the image recorded thereon to be outputted can be shortened.

Although the present invention has been shown and described with reference to a specific embodiment, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus comprising:

a recording medium supplying device that supplies a recording medium;

an image carrier arranged vertically beneath the recording medium supplying device with respect to a gravitation direction;

a carrying passage that transports the recording medium from the recording medium supplying device to a horizontal carrying portion arranged between the recording medium supplying device and the image carrier; and a transferring unit that transfers, a toner onto the recording medium when the recording medium is arranged substantially horizontally on the horizontal carrying portion, between the recording medium supplying device and the transferring unit, and vertically beneath the recording medium supplying device.

2. The image forming apparatus according to claim 1, further comprising a fixing unit that fixes the toner transferred by the transferring unit on the recording medium, wherein the fixing unit is arranged approximately in the horizontal direction with respect to a transfer position where the transferring unit transfers the toner onto the recording medium.

3. The image forming apparatus according to claim 2, wherein the fixing unit includes:

a fixing member that applies heat and pressure to the recording medium and to the toner transferred on the recording medium; and a reflecting layer arranged apart by 20 mm or less from the fixing member and having a metallic face with an emissivity of 0.5 or less.

4. The image forming apparatus according to claim 3, further comprising a temperature detecting unit that detects the temperature of the fixing unit, wherein the fixing member performs heating on the basis of at least the temperature detected by the temperature detecting unit.

5. The image forming apparatus according to claim 2, wherein the fixing unit is configured to be of an IH type.

6. The image forming apparatus according to claim 2, wherein the fixing unit has an heat insulating layer having a thickness of 3 mm or more and thermal conductivity of 0.3 W/mK or less.

7. The image forming apparatus according to claim 1, further comprising an inversion transporting unit that transports the recording medium with the toner transferred thereon by the transferring unit, while being inverted, to a more upstream side of the carrying passage with respect to the transferring unit, wherein the inversion transporting unit is arranged between the recording medium supplying unit and the image carrier.

8. The image forming apparatus according to claim 1, wherein the image carrier includes a photosensitive body.

9. The image forming apparatus according to claim 1, further comprising:

a plurality of photosensitive bodies that carries latent images;

a plurality of chargers that charges the photosensitive bodies;

an exposing unit that exposes the photosensitive bodies; and a plurality of developing units that develops the latent images carried on the photosensitive bodies with toners, wherein the image carrier includes an intermediate transferring member on which the toner images developed by the developing units are transferred from the photosensitive bodies.

10. The image forming apparatus according to claim 9, further comprising a plurality of photosensitive body driving devices that drives the photosensitive bodies, each of the photosensitive body driving devices having a shaft torque of 0.4 Nm or less and a driving force transmission efficiency of 60% or more.

11. The image forming apparatus according to claim 9, further comprising a plurality of developing unit driving devices that drives the plurality of developing units, the developing unit driving devices having a total shaft torque of 0.3 Nm or less and a driving force transmission efficiency of 70% or more.

12. The image forming apparatus according to claim 9, wherein the intermediate transferring unit is configured to increase a distance apart from the horizontal carrying portion from a duplicating position where the transferring unit transfers the toner image onto the recording medium toward the direction of transporting the recording medium.

13. The image forming apparatus according to claim 9, further comprising a plurality of toner supplying units that supplies the toners to each of the developing units, respectively, wherein the fixing unit includes a heat generating unit arranged above the plurality of developing units for heating the toners transferred on the recording medium, and wherein the toner supplying units are arranged between the developing units supplied with the toners and the heat generating unit.

14. The image forming apparatus according to claim 9, further comprising a plurality of toner supplying units that supplies the toners of at least yellow, magenta and cyan, to the developing units, respectively, wherein the fixing unit has a heat-generating unit arranged above the plurality of developing units for heating the toners transferred on the recording medium, and wherein the toner supplying units are arranged between the plurality of developing units and the heat generating unit.

15. The image forming apparatus according to claim 9, further comprising:

a plurality of photosensitive body cleaning units that cleans the plurality of photosensitive bodies; and an intermediate transferring member cleaning unit that cleans the an intermediate transferring member, wherein the photosensitive body cleaning units are arranged beneath the intermediate transferring member and are, at upper parts thereof, kept in sliding contact with the photosensitive bodies, respectively, and wherein the intermediate transferring member cleaning unit is arranged beneath the intermediate transferring member and is, at upper parts thereof, kept in sliding contact with the intermediate transferring member.

16. The image forming apparatus according to claim 1, wherein at least a plurality of photosensitive bodies, a plurality of developing units and an intermediate transferring member are configured to integrally move in a direction that leaves the transferring unit.

17. The image forming apparatus according to claim 9, further comprising:

a first unit including at least the photosensitive bodies and the developing units; and a second unit including at least the intermediate transferring member, wherein the first unit and the second unit are rotatively moved in a direction that leaves the transferring unit around a supporting shaft located at the position opposite to the transferring unit.

18. The image forming apparatus according to claim 13, wherein at least the photosensitive bodies, the developing units, the intermediate transferring member and the heat-generating unit are integrally moved in a direction that leaves the transferring unit.

19. The image forming apparatus according to claim 14, wherein at least the photosensitive bodies, the developing units, the intermediate transferring member and the heat-generating unit are integrally moved in a direction that leaves the transferring unit.

20. The image forming apparatus according to claim 13, further comprising:

a first unit including at least the photosensitive bodies, the developing units and the intermediate transferring member; and a second unit including at least the heat-generating unit, wherein the first unit and the second unit are rotatively moved in a direction that leaves the transferring unit around a supporting shaft located at the position opposite to the transferring unit.

21. The image forming apparatus according to claim 14, further comprising:

a first unit including at least the photosensitive bodies, the developing units and the intermediate transferring member; and a second unit including at least the heat-generating unit, wherein the first unit and the second unit are rotatively moved in a direction that leaves the transferring unit around a supporting shaft located at the position opposite to the transferring unit.

22. The image forming apparatus according to claim 13, further comprising:

a first unit including at least the photosensitive bodies and the developing unit; and a second unit including at least the intermediate transferring member and the heat-generating unit, wherein the first unit and the second unit are rotatively moved in a direction that leaves the transferring unit around a supporting shaft located at the position opposite to the transferring unit.

23. The image forming apparatus according to claim 14, further comprising:

a first unit including at least the photosensitive bodies and the developing unit; and a second unit including at least the intermediate transferring member and the heat-generating unit, wherein the first unit and the second unit are rotatively moved in a direction that leaves the transferring unit around a supporting shaft located at the position opposite to the transferring unit.

24. The image forming apparatus according to claim 13, further comprising:

a first unit including at least the photosensitive bodies and the plurality of developing unit;

a second unit including at least the intermediate transferring member; and a third unit including at least the heat-generating unit, wherein the first unit, the second unit and the third unit are rotatively moved in a direction that leaves the transferring unit around a supporting shaft located at the position opposite to the transferring unit.

25. The image forming apparatus according to claim 14, further comprising:

a first unit including at least the photosensitive bodies and the plurality of developing unit;

a second unit including at least the intermediate transferring member; and a third unit including at least the heat-generating unit, wherein the first unit, the second unit and the third unit are rotatively moved in a direction that leaves the transferring unit around a supporting shaft located at the position opposite to the transferring unit.

26. The image forming apparatus according to claim 17, wherein the first unit is rotatively moved together with the second unit within a predetermined range.

27. The image forming apparatus according to claim 17, wherein at least one of the first unit and the second unit is rotatively moved individually within a predetermined range.

28. The image forming apparatus according to claim 24, wherein the first unit is rotatively moved together with the second unit and the third unit within a predetermined range.

29. The image forming apparatus according to claim 25, wherein the first unit is rotatively moved together with the second unit and the third unit within a predetermined range.

30. The image forming apparatus according to claim 24, wherein at least one of the first unit, the second unit and the third unit is rotatively moved individually within a predetermined range.

31. The image forming apparatus according to claim 25, wherein at least one of the first unit, the second unit and the third unit is rotatively moved individually within a predetermined range.

32. The image forming apparatus according to claim 1, wherein the toner carried on the image carrier has a volume average grain diameter in a range of from 3.0 mm to 7.5 mm.

33. The image forming apparatus according to claim 1, wherein the toner carried on the image carrier contains at least binding resin to improve integrity.

34. The image forming apparatus according to claim 33, wherein the binding resin includes crystalline resin with a main constituent having a melting point in a range of from 50° C. to 120° C.

* * * * *